United States Patent [19]

Klein et al.

[11] Patent Number: 4,949,853

[45] **Date of Patent: * Aug. 21, 1990**

[54] CONVERTIBLE DESKTOP ORGANIZER

[75] Inventors: Harold S. Klein, Wayzata; Marcus S. Lehman, Lake City; Mark A. Feucht, Champlin, all of Minn.

[73] Assignee: Liberty Diversified Industries, New Hope, Minn.

[ * ] Notice: The portion of the term of this patent subsequent to Jan. 3, 2006 has been disclaimed.

[21] Appl. No.: 201,843

[22] Filed: Jun. 3, 1988

Related U.S. Application Data

[63] Continuation-in-part of Ser. No. 72,800, Jul. 13, 1987.

[51] Int. Cl.[5] ..... A47F 5/00

[52] U.S. Cl. ..... 211/186; 108/111; 211/10; 211/135; 211/184

[58] Field of Search ..... 211/186, 10, 135, 184; 108/111, 61

[56] References Cited

U.S. PATENT DOCUMENTS

| | | | |
|---|---|---|---|
| 3,269,788 | 8/1966 | Kneer . | |
| 3,737,046 | 6/1973 | Jeter | 211/10 |
| 3,807,572 | 4/1974 | Luvara et al. | 211/10 |
| 4,193,650 | 3/1980 | Gray et al. | 108/61 X |
| 4,208,818 | 6/1980 | Butcher | 211/184 X |
| 4,503,982 | 3/1985 | Lewis . | |
| 4,664,040 | 5/1987 | Leoenberg | 211/135 X |

FOREIGN PATENT DOCUMENTS

| | | | |
|---|---|---|---|
| 627954 | 9/1961 | Canada | 211/10 |

OTHER PUBLICATIONS

Catalog of Fidelity Summer Spectacular Coupon Sale pp. 12–16 and 124–127 as well as front and back covers.

*Primary Examiner*—Robert W. Gibson, Jr.
*Attorney, Agent, or Firm*—Moore & Hansen

[57] ABSTRACT

A desktop organizer comprising a pair of side wall panels attached to a rear wall which extends approximately the length of the back edge of a desk. The desktop organizer may include one or more shelves extending the full length of the organizer, or a portion of that length terminating in an intermediate wall panel, with the remainder of the length having a set of stacked shelves or other various modules. The desktop organizer may be open topped, or a top cap may be added which also serves to support additional items.

Each of the shelves includes a multiplicity of slots extending partially across the depth of the shelf generally perpendicular to the front and back edges thereof. The dividers may be inserted into the slots, each divider having one or more notches defined in the front edge of the divider which receives a portion of the shelf, the top of the divider being longer than the slot to prevent the divider from passing entirely through the slot. A tab or projection extending from the back edge of the divider at the same height as the notch is received within the slot only when the front portion of the shelf is received within the notch of the divider, to thereby secure the divider at a particular location and height relative to the shelf.

21 Claims, 4 Drawing Sheets

CONVERTIBLE DESKTOP ORGANIZER

This application is a continuation in part of the co-pending U.S. Pat. application Ser. No. 07/072,800 filed July 13, 1987.

BACKGROUND OF THE INVENTION

This invention relates generally to shelving and storage units which may placed upon a desk and used to organize paperwork and other articles on the desktop, and more particularly to a desk top organizer including shelves, dividers, and bins which extends along the length of the back edge of a desk top.

Various free standing or desktop organizers and filing systems having shelves and dividers are known to the art. Representative examples of such units include the shelf file disclosed in Canadian Patent No. 627,954 and the folding or hinged desk organizer disclosed in U.S. Pat. No. 4,664,040.

Shelving units or organizers which can be subdivided into separate compartments, or which may be combined with several differently configured but similar units, are also known. Examples of such assemblies are shown in U.S. Pat. Nos. 3,807,572 and 4,193,650.

The dividers utilized in the existing organizers are generally bent wire or sheet metal, and may be mounted in predetermined or variable positions using a variety of methods. Conventional mounting methods are disclosed in the patents referenced above, as well as U.S. Pat. Nos. 3,737,046 on a filing system, and U.S. Pat. No. 4,208,818 on a display device. It is common practice to also use stamped metal book ends as dividers with desktop organizers.

Attention is also drawn to the co-pending U.S. Patent application Ser. No. 07/072,800 relating to a mail sorting system which utilizes method for mounting dividers within slots or apertures at varying positions along shelving units, whereby the dividers are inserted through those slots in the shelves with a portion of each shelf being received within a notch defined by the edge of the divider, and with the divider being held in place relative to the shelf by a tab.

Among the desktop organizers which are particularly designed to rest on top of a desk along the rear edge thereof include those manufactured and marketed by Streamliners of Mechanicsburg, PA and those of the Safco and Fidelity Products companies of Minneapolis, MN. Such organizers typically have 1–3 transverse shelves supported from each end and along the rear edge thereof by a pair of side walls and a rear wall panel. The shelves may be subdivided into compartments using stamped metal dividers having clips which extend along the depth of the shelf and downwardly around the front edge of the shelf, similar to those shown in U.S. Pat. No. 4,664,040 referenced above.

Although the above designs for organizers have proven useful for many applications, each presents certain drawbacks which result in some inconveniences to the user. In particular, the user must generally preselect what type or style of desktop organizer is preferred from among a set number of designs, such as open top or closed top, with or without side bins, or side stacks of shelves located in a predetermined position. Consequently, for each style that a manufacturer wishes to produce and sell, separate forms or blanks must be stamped, and the cost of each unit therefore increases proportionately.

The adjustable dividers generally used with such desktop organizers do not have sufficient stability for the dividers to withstand any moderate sideways pressure exerted by supporting heavy objects such as phone books, manuals, or catalogs. In order to provide greater sideways stability, some desktop organizers have horizontal brackets with vertically aligned notches extending longitudinally along the back wall panels which permit the back edges of the dividers to be received within the notches for support. This also increases the manufacturing cost, and makes the divides hard to install on intermediate shelves.

BRIEF SUMMARY OF THE INVENTION

It is therefore one object of this invention to design a desktop organizer which may comprise a basic frame structure and which permits separate dividers and modular components to be utilized to form several overall designs and structures particularly suited to various applications.

It is a further object of this invention to design the above desktop organizer such that it incorporates a method of mounting the dividers in various positions relative to the length of the shelves.

Briefly described, the desktop organizer of this invention comprises a pair of side wall panels attached to a back wall which extends approximately the length of the back edge of a desk. The desktop organizer may include one or more shelves extending the full length of the organizer, or a portion of that length terminating in an intermediate panel, with the remainder of the length having a set of stacked shelves or other various modules. The desktop organizer may be open topped, or a separate top cap may be added which extends across the entire top of the desk organizer and may be used as a support for additional items. Corner trays may be received within mounting brackets and secured therein.

Each of the shelves includes a multiplicity of slots extending partially across the depth of the shelf generally perpendicular to the front and back edges thereof. The dividers may be inserted into the slots, each divider having one or more notches defined in the front edge of the divider which receives a portion of the shelf, the top of the divider being longer than the slot to prevent the divider from passing entirely through the slot. A locking tab extending from the back edge of the divider at the same height as the notch is received within the slot only when the front portion of the shelf is received within the notch of the divider, to thereby secure the divider at a particular location and height relative to the shelf.

DESCRIPTION OF THE PREFERRED EMBODIMENT

Figure 1:
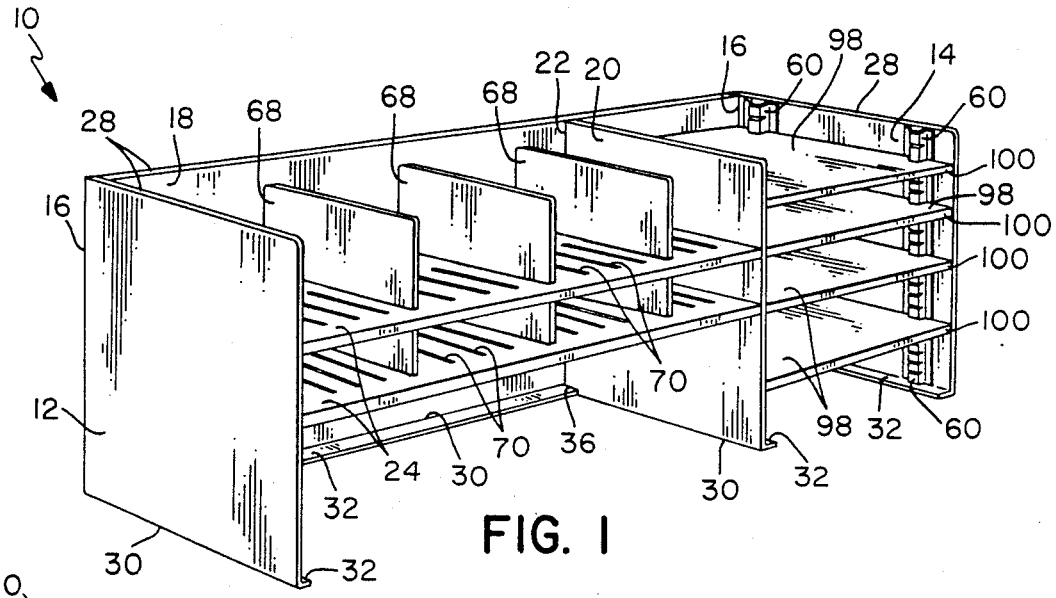
FIG. 1 is a perspective view of one embodiment of the desktop organizer of this invention.

The desktop organizer of this invention is shown in FIGS. 1–12 and referenced generally therein by the numeral 10.

Referring particularly to FIGS. 1–5, it may be seen that the desktop organizer 10 is comprised generally of a pair of opposing side wall panels 12, 14 each oriented in a generally vertical plane parallel to one another. The side wall panels 12, 14 are connected along the back edges 16 thereof to a back wall panel 18 which extends between the side wall panels 12, 14 and is oriented in a generally vertical plane perpendicular to the side wall panels 12, 14. The side wall panels 12, 14 may be connected to the back wall panel 18 by hinges such that the side wall panels 12, 14 may be pivoted relative to the back wall panel 18, or in any other suitable manner.

The desktop organizer may additionally and optionally include one or more intermediate panels 20 disposed between the side wall panels 12, 14 and oriented generally parallel thereto, the intermediate panels 20 being connected to the rear panel 18 along the back edge 22 of each intermediate panel 20.

Referring to FIGS. 1–5, it may be seen that extending between the side wall panels 12, 14, or alternately between one of the side wall panels 12, 14 and one of the intermediate panels 20, are one or more generally horizontal shelves 24, each shelf 24 being oriented in a generally horizontal plane perpendicular to both the side wall panels 12, 14 and back wall panel 18, and generally parallel to the horizontal top surface of the desk or table (not shown) on which the desktop organizer 10 is rested. Each shelf 24 and the side wall panels 12, 14 has a depth which may be selected for various applications, but is preferred in some applications to be deep enough to permit standard size computer printout sheets to be placed on the shelves 24 without extending over the front edge thereof As such, each shelf 24 should be approximately 10" to 12" in depth.

Figure 2:
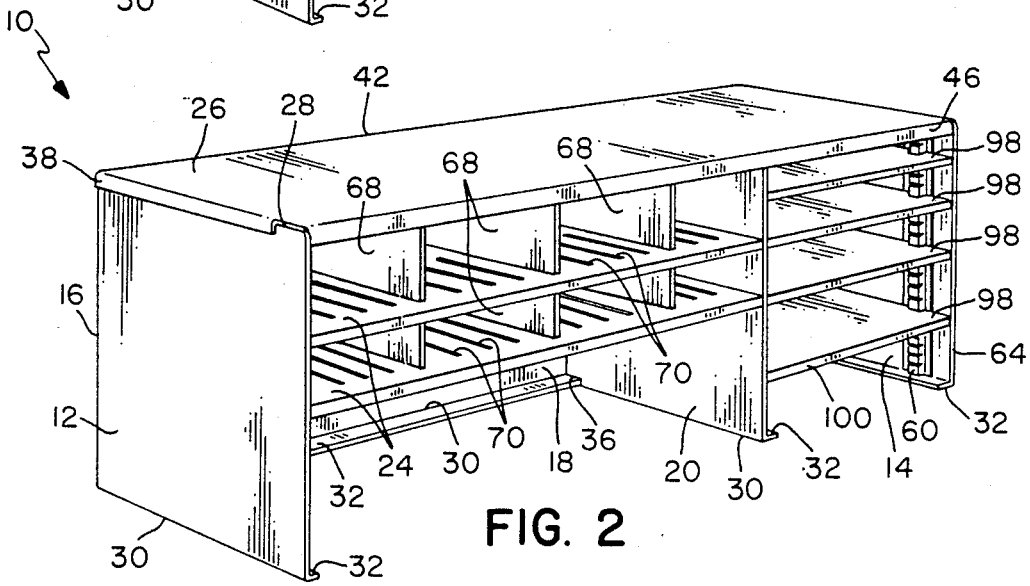
FIG. 2 is a perspective view of one embodiment of the desktop organizer of this invention.
Figure 4:
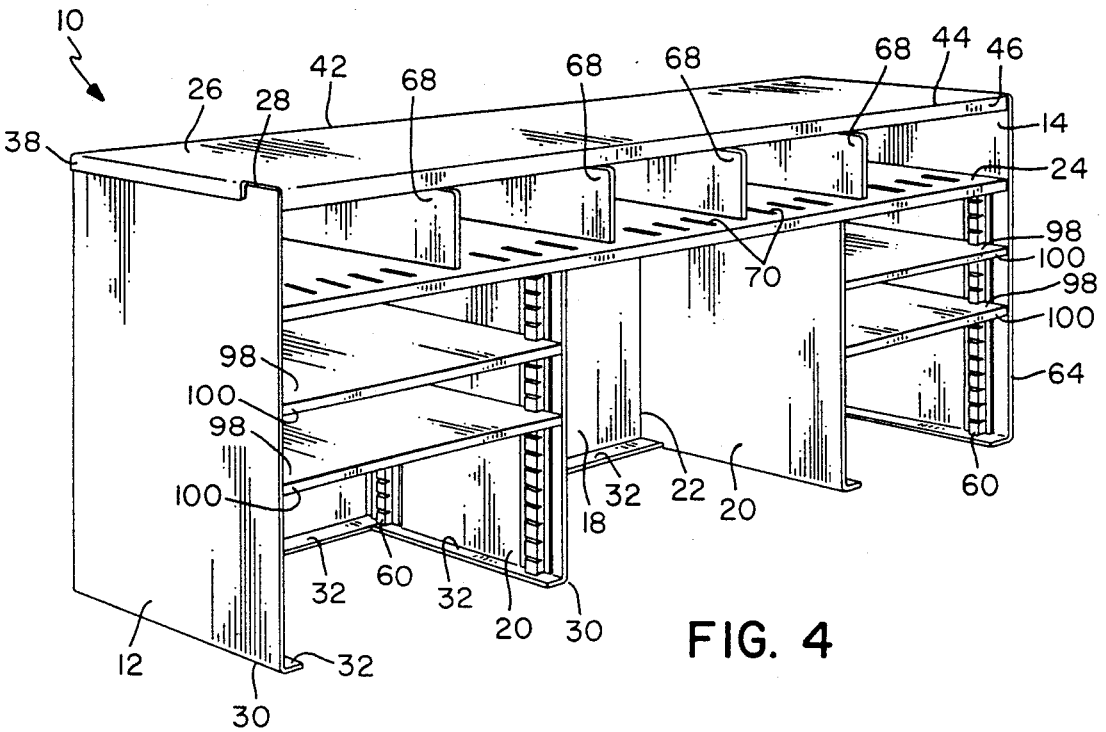
FIG. 4 a perspective view of one embodiment of the desktop organizer of this invention.

Referring to FIGS. 2 and 4, in some applications it may be preferable to span the top of the desk organizer with a top cap piece 26 which may serve as an additional shelf, and which is oriented generally parallel to the shelves 24 and disposed along the top edges 28 of the side wall panels 12, 14 and back wall panel 18.

It is understood that the shelves 24 may be fashioned so as to be removably connectable to and supported by the side wall panels 12, 14, intermediate panels 20, and back wall panel 18. The method for mounting the shelves may comprise any conventional tongue and groove assembly, tab and slot assembly, or other suitable mounting structure. In some instances in which maximum support is required, it may be preferable to securely fasten or permanently attach the shelves 24 to either the side wall panels 12, 14, intermediate panels 20, or back wall panel 18.

Figure 3:
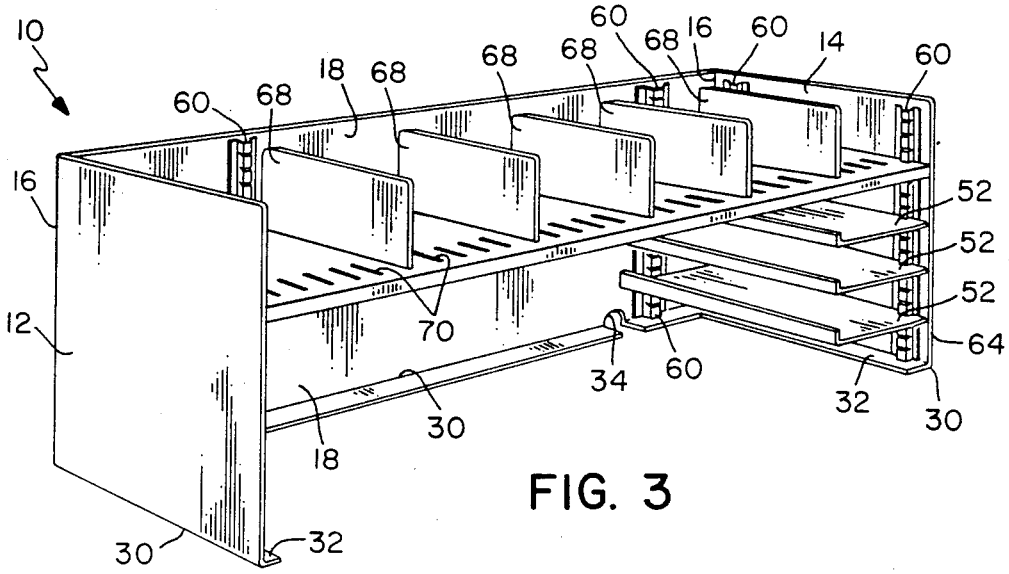
FIG. 3 is a perspective view of one embodiment of the desktop or of this invention.

The bottom edge 30 of each of the side wall panels 12, 14, intermediate panels 20, and back wall panel 18 may include a base ledge 32 extending inwardly from the respective panel 12, 14, 18, 20 generally perpendicular thereto, to provide a greater footprint between the desktop organizer 10 and desktop surface, increase the stability of the desktop organizer 10, and prevent it from "walking" as heavy objects are placed on or removed from the shelves 24. The back panel 18 and base ledge 32 attache thereto may also form or define one or more rear cutouts 34 as shown in FIG. 3 to permit cords and wires to extend through the back of the desktop organizer 10, thereby allowing electrical devices to be placed on the surface of the desk beneath the lowermost shelf 24.

In some instances the intermediate panel 20 should be connected along its rearmost vertical edge 22 to the back wall panel 18, or alternately may be fashioned such that the lowermost portion of the rearmost vertical edge 22 of the intermediate panel 20 is engagingly received within a notch 36 cut into and extending completely through the base ledge 32 of the back wall panel 18, such that the lower edge 30 of the intermediate panel 20 will not shift longitudinally along the length of the desktop organizer 10.

In order to permit the construction of the desktop organizer 10 as described above, it is contemplated that the side wall panels 12, 14, back wall panel 18, intermediate panels 20, shelves 24, and top cap piece 26 are to be stamped and folded from generally planar sections of substantially rigid sheet metal of the type conventionally used in similar office furniture and accessories.

Figure 7:
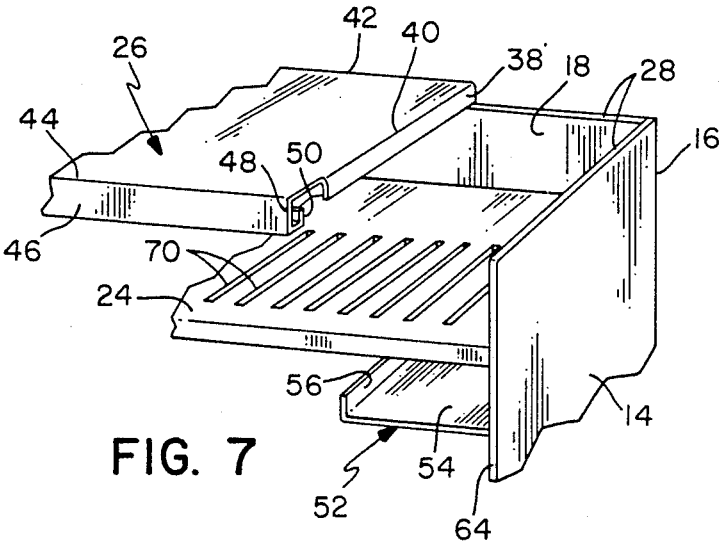
FIG. 7 is a partial perspective view of the desktop organizer of FIG. 1 indicating the manner in which the top cap piece is mounted on the top edges of the side wall panels and back wall panel.

Referring to FIG. 7, one preferred method for installing the top cap piece 26 onto the desktop organizer 10 is illustrated. The top cap piece 26 includes a pair of side ledge members 38 each extending downwardly from one of the opposing side edges 40 of the top cap piece 26. The side ledge members 38 extend from the back edge 42 of the top cap piece 26 forwardly and terminate a short distance before the front edge 44 of the top cap piece 26. Extending generally perpendicularly downward a distance greater than the height of the side ledge members 38 from the front edge 44 of the top cap piece 26 is a front ledge member 46, the front ledge member 46 including a rearwardly projecting flange member 48 oriented generally perpendicular to the front ledge member 46 and connected to and extending from the bottom edge thereof, and an upwardly extending lip member 50 oriented generally perpendicular to the rearwardly projecting flange member 48 and connected to and extending from the rear edge thereof. The rearwardly projecting flange member 48 and upwardly projecting lip member 50 extend back a distance from the front ledge member 46 terminating in front of the side ledge members 38. The side ledge members 38 are spaced apart from the side edges 40 of the top cap piece 26 a distance approximately equal to the thickness of the material used to form the top edges 28 of the side wall panels 12, 14. The top cap piece 26 may additionally include a rear ledge member (not shown) which is spaced apart from and extends downwardly from the rear edge 42 of the top cap piece 26 along the length thereof in a manner similar to the side ledge members 38.

In operation, the top cap piece 26 is positioned above the desktop organizer 10 such that the side edge members 38 are disposed adjacent to the top edges 28 of the side wall panels 12, 14, and the top cap piece is then pressed downward such that the side ledge members 38 contact and closely confront the exterior surfaces of the side wall panel 12, 14, and the top edges 28 of the side wall panels 12, 14 contact the bottom planar surface of the top cap piece 26. The rear ledge member similarly closely confronts and contacts the rear exterior surface of the back wall panel 18. The side edges of the rearwardly projecting flange member 48 and upwardly projecting lip member 50 are received between and closely confront and contact the interior surfaces of the side wall panels 12, 14, such that pressure is exerted on both the interior and exterior surfaces of the side wall panels 12, 14 by the rearwardly projecting flange member 48, upwardly projecting lip member 50, and side ledge members 38 to securely engage the top cap piece 26 on the side wall panels 12, 14 and back wall panel 18.

Figure 6:
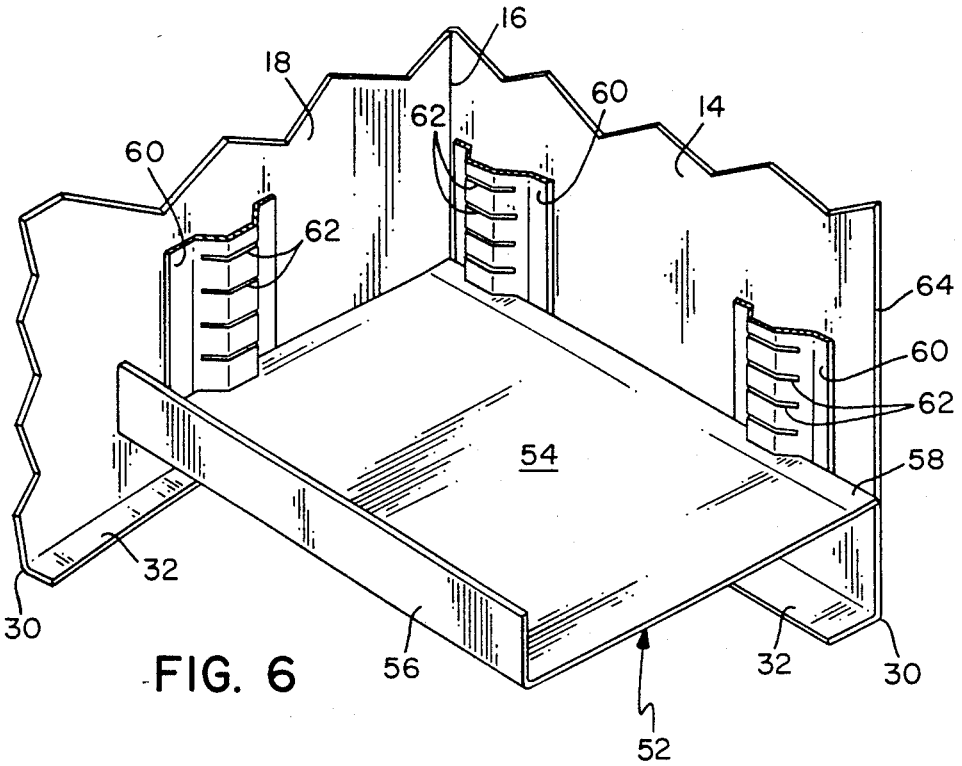
FIG. 6 a partial perspective view of the desktop organizer of FIG. 1 indicating the mounted position of one of the corner trays.
Figure 8:
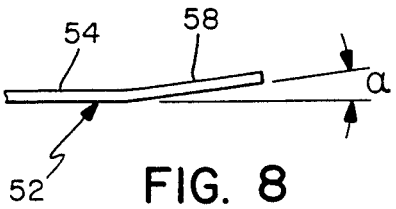
FIG. 8 is a partial side view showing the side edge of the corner tray of FIG. 6.

Referring to FIG. 3, it may be seen that the desktop organizer may include a plurality of suspended corner trays 52 extending inwardly from either side of the desktop organizer 10. Referring to FIGS. 6–8, the corner tray 52 may comprise a generally planar tray portion 54 having a size approximately equal to or slightly larger than a conventional sheet of paper or file folder, an angled or perpendicular upturned lip member 56 opposing the adjacent side wall 14, and a slightly angled side edge 58. To facilitate mounting the corner trays 52, the side wall panel 14 has attached to the interior surface thereof a pair of vertically oriented mounting brackets 60 having a half-hexagonal cross section when viewed from above. Each bracket 60 has a multiplicity of notches 62 cut through and extending horizontally there across, each notch 62 having a width or height substantially equal to or slightly greater than the thickness of the material used to form the corner tray 52. The brackets 60 are positioned proximate to the front edges 64 and back edges 16 of the side wall panels 12, 14. A similar bracket 60 is attached to the back wall panel 18 a distance from the adjacent side wall panel 14 less than the width of the corner tray 52.

The corner tray 52 is preferably constructed from a springy, semi-rigid material such that the corner tray 52 will flex or bend slightly, particularly in the region adjacent to the slightly angled side edge 58. The slightly angled side edge 58 is angled upwardly relative to the planar tray section 54 by an angle a of less than 10 degrees.

In operation, the slightly angled side edge 58 is oriented generally horizontally and inserted into the notches 62 of the brackets 60 attached to the side wall panel 14. The angle a of the slightly angled side edge 58 results in the position of the opposing upturned lip member 56 being raised a distance approximately equal to the distance between two adjacent notches 62 of the bracket 60 attached to the back wall panel 18, and disposed approximately one notch 62 above the height of the notches 62 receiving the slightly angled side edge 58 of the corner tray 52. The planar tray portion 54 is then pressed downward to pivot the rear edge 66 of the corner tray 52 into alignment with the notch 62 of the bracket 60 attached to the back wall panel 18. The corner tray 52 is then slidably moved rearwardly such that the rear edge 66 is received within the notch 62, and the downward pressure on the corner tray 52 is released. The spring-like nature of the corner tray 52 will then hold and securely engage the edges 58, 66 of the corner tray within the notches 62 of the brackets 60, and suspend and support the corner tray from three points along those two edges 58, 66. It is also anticipated that in some applications it would be sufficient to place one mounting bracket 60 in the center of the side wall panel 14 rather than using two mounting brackets 60.

Figure 5:
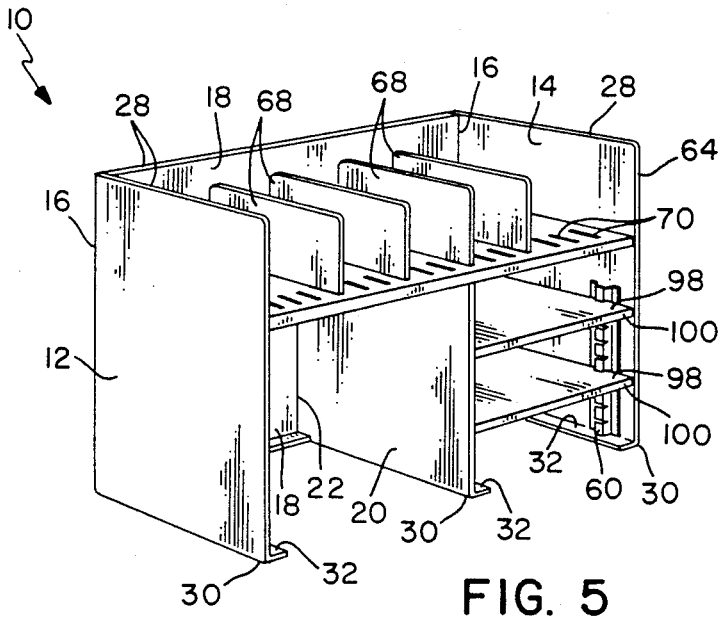
FIG. 5 is a perspective view of one embodiment of the desktop organizer of this invention.

Referring again to FIGS. 1–5, the desktop organizer 10 preferably includes a partitioning system comprising in combination with the shelves 24 a plurality of dividers 68 spaced apart and selectively positioned along the shelves 24, the dividers 68 being received within a multiplicity of slots 70 formed in the shelves 24. The slots 70 may comprise one of two types, the long slot 70 as shown in FIGS. 1 and 2, or the paired short slots 70 as shown in FIGS. 3–5.

Figure 9:
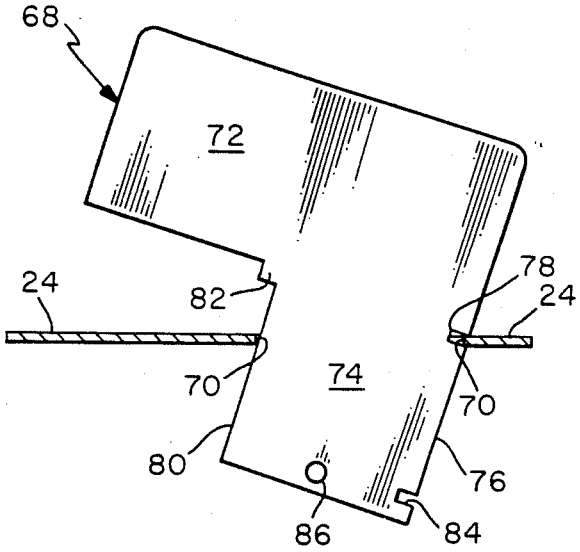
FIG. 9 a side cross sectional view showing a divider partially installed in one of the shelves of the desktop organizer of FIG. 1.
Figure 10:
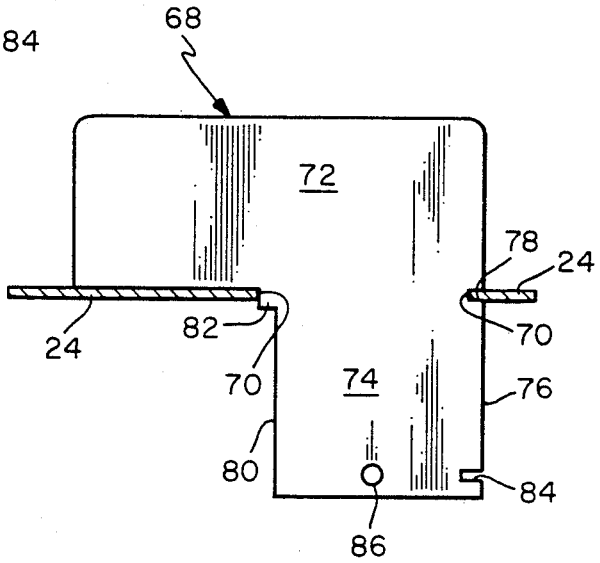
FIG. 10 is a side cross sectional view showing a divider completely installed in one of the shelves of the desktop organizer of FIG. 1.

Referring particularly to FIGS. 9 and 10, the embodiment comprising long slots 70 is shown. Each divider 68 has an upper partition portion 72 which is disposed above the shelf 24 when installed as shown in FIG. 10, and a depending stabilizing fin portion 74 disposed below the shelf 24 when installed as shown in FIG. 10. The width or depth of the depending fin portion 74 is approximately equal to the depth of each slot 70 in the shelf 24, such that the depending fin portion 74 may be slidably received within the slot 70. The depth of the upper partition portion 72 is significantly greater than the depth of the slots 70, such that the divider 68 will not be received through the shelf 24 further than the dividing line between the upper partition portion 72 and the depending fin portion 74.

Referring to FIG. 9, it may be seen that the front edge 76 of the divider 68 defines a notch 78 having a height substantially equal to the thickness of the material used to form the shelf 24. The top edge of the notch 78 is aligned with the dividing line between the upper partition portion 72 and the depending fin portion 74, and with the top planar surface of the shelf 24 when the divider is installed, as shown in FIG. 10. Referring again to FIG. 9, it may also be seen that the rear edge 80 of the depending fin portion 74 adjacent to the upper partition portion 72 defines a locking tab 82 which extends rearwardly from the rear edge 80 of the depending fin portion 74 a distance equal to the depth of the notch 78 defined by the front edge 76 of the divider 68, and downwardly from the upper partition portion 72 a distance greater than the thickness of the shelf 24.

The depth of each slot 70 measured between the front and back edges thereof is thus slightly greater than or substantially equal to the length of the depending fin portion 74, the length being a distance measured between a point on the front edge 76 of the depending fin portion 74 and a point on the rear edge of the locking tab 82. If a notch 78 is included on the divider 68, then the point on the front edge 76 of the depending fin portion 74 from which that distance is measured should be along the back edge of the notch 78. It should also be noted that the dividers 68 may be constructed in mirror image to those shown in the drawing FIGS. 9–12.

In operation, the depending fin portion 74 of the divider 68 is inserted into and slidably received within a selected one of the slots 70 with the rear edge 80 of the depending fin portion 74 contacting the rear edge of the slot 70. When the locking tab 82 contacts the top surface of the shelf 24, the front edge 76 of the divider 68 may be tilted forward and downward such that the notch 78 in the front edge 76 of the divider is aligned with the shelf 24. The divider 68 is then slidably moved forward such that a portion of the shelf 24 is received within the notch 78, and the rear edge 80 of the divider 68 is tilted downwardly such that the locking tab 82 is received within the slot 70 to securely engage the divider 68 within the slot 70 in the shelf 24.

The divider 68 may also include a second lower notch 84 defined by the front edge 76 and spaced apart below the upper notch 70 a distance equal to the distance between the first shelf 24 and a lower shelf 24 disposed beneath the first shelf 24. As such, the lower notch 84 is recessed into the divider 68 and may receive a portion of the lower shelf 24 in the same manner as the upper notch 70 receives a portion of the upper shelf 24, with the depending fin portion 74 being received in one of a plurality of slots 70 in vertical alignment with those slots 70 in the main shelf 24 above the lower shelf 24. The divider 68 may also define an aperture 86 used for hanging or bundling several of the dividers 68 together.

Figure 12:
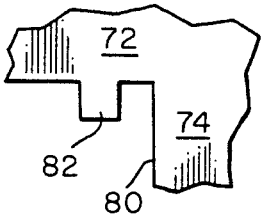
FIG. 12 is a partial side elevation view showing an alternate embodiment of the locking tab of the divider of FIG. 10.

Referring to FIG. 12, an alternate embodiment of the locking tab 82 is shown in which the locking tab 82 extends downwardly from the bottom edge of the upper partition portion 72 and is spaced apart from the depending fin portion 74 of the divider 68. It is also contemplated that the upper notch 78 may extend downwardly along the full length or height of the front edge 76 of the depending fin portion 74 of the divider 68.

Figure 11:
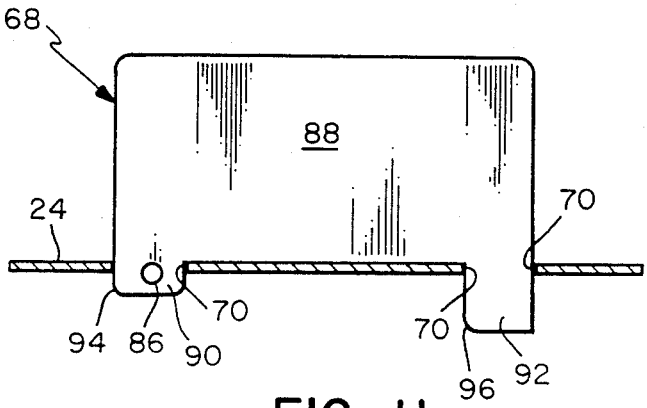
FIG. 11 is a side cross sectional view showing a divider completely installed in one of the shelves of the desktop organizer of FIG. 3.

Referring to FIG. 11, the embodiment comprising paired short slots 70 as in FIGS. 3–5 is shown. Each divider 68 has an upper partition portion 88 which is disposed above the shelf 24 when installed as shown in FIG. 11, and a pair of depending stabilizing fins 90, 92. The front stabilizing fin 92 extends downwardly from the upper partition portion 88 a distance greater than the rear stabilizing fin 90 extends, each stabilizing fin 90, 92 being slidably received within a corresponding aligned paired slot 70 adjacent to either the front or back of the shelf 24. The corners 94 of the rear stabilizing fin 90 may be rounded, as is the rear corner 96 of the front stabilizing fin 92.

In some applications in which an intermediate panel 20 is utilized, it may be preferable to replace the corner trays 52 with a plurality of stacked shelves 98. The stacked shelves 98 are each received within the notches 62 of mounting brackets 60 similar to those used to support the corner trays 52 and positioned on the inner surface of the corresponding side panel 12, 14 and the opposing and confronting surface of the intermediate panel 20 as shown in FIGS. 1, 2, 4, and 5. In these instances, it is understood that the edges of the stacked shelves 98 are not angled or inclined as in the corner trays 52, but are slidingly received within notches 62 having the same height on either side of the shelves 98. The front edge of each stacked shelf 98 may form a down-turned ledge 100 similar to the front ledge 46 of the top cap piece 26. In some instances where an intermediate panel 20 and stacked shelves 98 are used, it may be preferable to form the back wall panel 18 in two separate pieces, each corresponding in length to a separate portion of the desktop organizer 10, such as having one piece correspond in length and position to the longer shelves 24 as shown in FIG. 2, and the second portion correspond in length and position to the stacked shelves 98. This permits the same back wall panel 18 to be utilized to form a desktop organizer 10 having the stacked shelves 98 on either the right hand or left hand side of the long shelves 24. Similarly, a plurality of shorter back wall panels 18 may be used to form desktop organizers of varying sizes and configurations such as those shown in FIGS. 4 and 5.

While the preferred embodiment of the above desktop organizer 10 has been described in detail above with reference to he attached drawing figures, it is understood that various changes and adaptations may be made in the desktop organizer without departing from the spirit and scope of the appended claims.

What is claimed is:

1. In a desktop organizer of the type having at least one generally vertical side wall panel and one generally vertical back wall panel connected to an extending generally perpendicularly from said side wall panel, said side wall panel and said back wall panel each having a surface facing an interior region of said desktop organizer, the improvement comprising:

at least one corner tray, said corner tray having a generally planar tray portion, said tray portion further having a pair of side edges and a width measured between said side edges, said tray portion further having a back edge, a portion of said corner tray adjacent to one of said side edges being angled upwardly relative to said planar tray portion; and at least two mounting brackets, one of said mounting brackets being connected to and oriented generally vertically on the surface of the side wall panel facing the interior region of the desktop organizer and one of said mounting brackets being connected to and oriented generally vertically on the surface of the back wall panel facing the interior region of the desktop organizer, said mounting brackets each defining a plurality of notches extending through said mounting bracket and oriented in a generally horizontal direction, said notches in the mounting bracket connected to the side wall panel being sized so as to slidably receive a segment of the side edges of the corner tray therein, said notches in the mounting bracket connected to the back wall panel being sized so as to slidably receive a segment of the back edge of the tray portion therein, said notches further being positioned such that the notches in the mounting bracket connected to the side wall panel are at substantially the same vertical height as the notches in the mounting bracket connected to the back wall panel, whereby the upwardly angled side edge may be oriented generally horizontally and inserted into one of the notches of the mounting bracket attached to the side wall panel such that the opposing side edge of the tray portion is raised a distance vertically relative to the notch in which the upwardly angled side edge is received, the side edge of the tray portion opposing the upwardly angled side edge then being pressed downwardly to flex the corner tray and to pivot the rear edge of the tray portion into alignment with one of the notches of the mounting bracket connected to the back wall panel such that the tray portion may be slidably moved rearwardly until the segment of the rear edge of the tray portion is received within the one of the notches of the mounting bracket connected to the back wall panel to securely engage and support the corner tray.

2. A partitioning system for use in a desktop organizer, said partitioning system comprising:

at least one generally horizontal main shelf, said main shelf having a length and a pair of opposing front and back edges, said main shelf further defining a plurality of generally uniform slots extending through said main shelf generally parallel to one another and generally perpendicular to said front and back edges of said main shelf, each said slot having a front edge and a back edge and a depth measured between said front edge and said back edge; and at least one divider, said divider having an upper partition portion and a depending fin portion, said upper partition portion having a front edge and a back edge and a length measured therebetween, said length of said upper partition portion being greater than the depth of the slots defined by the main shelf, said depending fin portion having a front edge and a back edge and a length measured therebetween, said length of said depending fin portion being less than the depth of the slots defined by the main shelf, such that said depending fin portion of said divider may be slidably received within one of said slots but said upper partition portion may not pass through said slot, said divider further defining a locking tab portion connected to and extending from the back edge of the depending fin portion, said locking tab having a back edge, and such that a distance measured between at least a point on the front edge of the divider and a point on the back edge of the locking tab is substantially equal to or slightly less than the length of the slot into which the depending fin portion of the divider is received.

3. The partitioning system of claim 2 wherein the front edge of the depending fin portion of the divider further defines a notch, said notch being recessed into the depending fin portion and further having a rear edge, and wherein the point on the front edge of the depending fin portion of the divider from which the distance to the point on the rear edge of the depending fin portion is measured is located on said rear edge of the notch, such that a portion of the main shelf may be received within said notch when the divider is mounted on the main shelf.

4. The partitioning system of claim 3 wherein the main shelf has a thickness, and wherein the notch has a height, the height of the notch being slightly greater than the thickness of the main shelf.

5. The partitioning system of claim 3 further comprising:

a lower shelf disposed a distance beneath the main shelf, said lower shelf having a length and a pair of opposing front and back edges, said lower shelf further defining a plurality of generally uniform slots extending through said lower shelf generally parallel to one another and generally perpendicular to said front and back edges of said lower shelf, said slots defined by said lower shelf being in generally vertical alignment with and parallel to the slots in the main shelf above the lower shelf, each said slot in the lower shelf having a front edge and a back edge and a depth measured between said front edge and said back edge, and wherein the front edge of the depending fin portion of the divider further defines a lower notch, said lower notch being recessed into the depending fin portion and being spaced such that a portion of the lower shelf may be received within the lower notch when the divider is mounted to the main shelf.

6. A partitioning system for use in a desktop organizer, said partitioning system comprising:

at least one generally horizontal shelf, said shelf having a length and a pair of opposing front and back edges, said shelf further defining a plurality of generally uniform slots extending through said shelf generally parallel to one another and generally perpendicular to said front and back edges of said shelf, each said slot having a front edge and a back edge and a depth measured between said front edge and said back edge; and at least one divider, said divider having an upper partition portion and a depending fin portion, said upper partition portion having a front edge and a back edge and a length measured therebetween, said length of said upper partition portion being greater than the depth of the slots defined by the shelf, said depending fin portion having a front edge and a back edge and a length measured therebetween, said length of said depending fin portion being less than the depth of the slots defined by the shelf, such that said depending fin portion of said divider may be slidably received within one of said slots but said upper partition portion may not pass through said slot, said divider further defining a locking tab portion connected to and extending from the front edge of the depending fin portion, said locking tab having a front edge, and such that a distance measured between at least a point on the back edge of the divider and a point on the front edge of the locking tab is substantially equal to or slightly less than the length of the slot into which the depending fin portion of the divider is received

7. The partitioning system of claim 6 wherein the back edge of the depending fin portion of the divider further defines a notch, said notch being recessed into the depending fin portion and further having a front edge, and wherein the point on the rear edge of the depending fin portion of the divider from which the distance to the point on the front edge of the depending fin portion is measured is located on said front edge of the notch, such that a portion of the shelf may be received within said notch when the divider is mounted on the shelf.

8. The partitioning system of claim 7 wherein the shelf has a thickness, and wherein the notch has a height, the height of the notch being slightly greater than the thickness of the shelf.

9. The partitioning system of claim 7 further comprising:

a lower shelf disposed a distance beneath the main shelf, said lower shelf having a length and a pair of opposing front and back edges, said lower shelf further defining a plurality of generally uniform slots extending through said lower shelf generally parallel to one another and generally perpendicular to said front and back edges of said lower shelf, said slots defined by said lower shelf being in generally vertical alignment with and parallel to the slots in the main shelf above the lower shelf, each said slot in the lower shelf having a front edge and a back edge and a depth measured between said front edge and said back edge, and wherein the back edge of the depending fin portion of the divider further defines a lower notch, said lower notch being recessed into the depending fin portion and spaced such that a portion of the lower shelf may be received within the lower notch when the divider is mounted to the main shelf.

10. A partitioning system for use in a desktop organizer, said partitioning system comprising:

at least one generally horizontal shelf, said shelf having a length and a pair of opposing front and back edges, said shelf further defining a plurality of generally uniform slots extending through said shelf generally parallel to one another and generally perpendicular to said front and back edges of said shelf, each said slot having a front edge and a back edge and a depth measured between said front edge and said back edge; and at least one divider, said divider having an upper partition portion and a depending fin portion, said upper partition portion having a front edge and a back edge and a length measured therebetween, said length of said upper partition portion being greater than the depth of the slots defined by the shelf, said depending fin portion having a front edge and a back edge and a length measured therebetween, said length of said depending fin portion being less than the depth of the slots defined by the shelf, such that said depending fin portion of said divider may be slidably received within one of said slots but said upper partition portion may not pass through said slot, said divider further defining a locking tab portion connected to and extending downwardly from the upper partition portion, said locking tab having a back edge, and such that a distance measured between at least a point on the front edge of the divider and a point on the back edge of the locking tab is substantially equal to or slightly less than the length of the slot into which the depending fin portion of the divider is received.

11. The partitioning system of claim 10 wherein the front edge of the depending fin portion of the divider further defines a notch, said notch being recessed into the depending fin portion and further having a rear edge, and wherein the point on the front edge of the depending fin portion of the divider from which the distance to the point on the rear edge of the depending fin portion is measured is located on said rear edge of the notch, such that a portion of the shelf may be received within said notch when the divider is mounted on the shelf.

12. The partitioning system of claim 11 wherein the shelf has a thickness, and wherein the notch has a height, the height of the notch being slightly greater than the thickness of the shelf.

13. The partitioning system of claim 11 further comprising:

a lower shelf disposed a distance beneath the main shelf, said lower shelf having a length and a pair of opposing front and back edges, said lower shelf further defining a plurality of generally uniform slots extending through said lower shelf generally parallel to one another and generally perpendicular to said front and back edges of said lower shelf, said slots defined by said lower shelf being in generally vertical alignment with and parallel to the slots in the main shelf above the lower shelf, each said slot in the lower shelf having a front edge and a back edge and a depth measured between said front edge and said back edge, and wherein the front edge of the depending fin portion of the divider further defines a lower notch, said lower notch being recessed into the depending fin portion and being spaced such that a portion of the lower shelf may be received within the lower notch when the divider is mounted to the main shelf.

14. A partitioning system for use in a desktop organizer, said partitioning system comprising:

at least one generally horizontal shelf, said shelf having a length and a pair of opposing front and back edges, said shelf further defining a plurality of generally uniform slots extending through said shelf generally parallel to one another and generally perpendicular to said front and back edges of said shelf, each said slot having a front edge and a back edge and a depth measured between said front edge and said back edge; and at least one divider, said divider having an upper partition portion and a depending fin portion, said upper partition portion having a front edge and a back edge and a length measured therebetween, said length of said upper partition portion being greater than the depth of the slots defined by the shelf, said depending fin portion having a front edge and a back edge and a length measured therebetween, said length of said depending fin portion being less than the depth of the slots defined by the shelf, such that said depending fin portion of said divider may be slidably received within one of said slots but said upper partition portion may not pass through said slot, said divider further defining a locking tab portion connected to and extending downwardly from the upper partition portion, said locking tab having a front edge, and such that a distance measured between at least a point on the back edge of the divider and a point on the front edge of the locking tab is substantially equal to or slightly less than the length of the slot into which the depending fin portion of the divider is received.

15. The partitioning system of claim 14 wherein the back edge of the depending fin portion of the divider further defines a notch, said notch being recessed into the depending fin portion and further having a front edge, and wherein the point on the back edge of the depending fin portion of the divider from which the distance to the point on the front edge of the depending fin portion is measured is located on said front edge of the notch, such that a portion of the shelf may be received within said notch when the divider is mounted on the shelf.

16. The partitioning system of claim 15 wherein the shelf has a thickness, and wherein the notch has a height, the height of the notch being slightly greater than the thickness of the shelf.

17. The partitioning system of claim 15 further comprising: a lower shelf disposed a distance beneath the main shelf, said lower shelf having a length and a pair of opposing front and back edges, said lower shelf further defining a plurality of generally uniform slots extending through said lower shelf generally parallel to one another and generally perpendicular to said front and back edges of said lower shelf, said slots defined by said lower shelf being in generally vertical alignment with and parallel to the slots in the main shelf above the lower shelf, each said slot in the lower shelf having a front edge and a back edge and a depth measured between said front edge and said back edge, and wherein the back edge of the depending fin portion of the divider further defines a lower notch, said lower notch being recessed into the depending fin portion and being spaced such that a portion of the lower shelf may be received within the lower notch when the divider is mounted to the main shelf.

18. A desktop organizer comprising:

a pair of opposing side wall panels, each said side wall panel having a top edge and a back edge and being oriented in a generally vertical position;

at least one back wall panel connected to and extending between the opposing side wall panels along the back edges thereof, said back wall panel being oriented in a generally vertical direction;

a first shelf member, said shelf member being connected to at least one of said side wall panels and supported in a generally horizontal position;

a plurality of generally vertical dividers, each said divider being removably mountable on said shelf member, said shelf member defining a plurality of generally parallel slots extending completely through said shelf member into which said dividers may be selectively and engagingly received; and means for fastening the dividers to the shelving members.

19. The desktop organizer of claim 18 having a length, said desktop organizer further comprising:

an intermediate panel, said intermediate panel having a back edge and being oriented in a generally vertical direction generally parallel with the side wall panels; and a second shelf member, said second shelf being connected to said intermediate panel and to the side wall panel opposing the side wall panel to which the first shelf member is connected, said second shelf member being supported in a generally horizontal position and having a length, the first shelf member being connected to the intermediate panel and also having a length, said length of the first shelf member plus the length of the second shelf member being substantially equal to the length of the desktop organizer.

20. The desktop organizer of claim 18 having a length, said desktop organizer further comprising:

a second shelf member, said second shelf member being supported in a generally horizontal position and disposed beneath the first shelf member, said second shelf member defining a plurality of generally parallel slots extending completely through said second shelf member into which at least a portion of the dividers may be received, said slots defined by said second shelf member being in vertical alignment with the slots defined by the first shelf member.

21. The desktop organizer of claim 18 wherein each side wall panel has an interior and an exterior planar surface, said desktop organizer further comprising:

a top cap piece mountable on the top edges of the side wall panels, said to cap piece having a pair of side edges and a length measured therebetween, said top cap piece further having a pair of depending ledges, each ledge connected to and depending from one of said side edges of the top cap piece and each being positionable in close confronting contact with the exterior planar surface of one of the opposing side wall panels, said op cap piece further having at least one depending front ledge member, said depending front ledge member having opposing ends, said opposing ends each being positionable in close confronting contact with the interior planar surface of one of the opposing side wall panels, such that the top cap piece may be engagingly and removably mounted on the top edges of the side wall panels.

* * * * *